US012607380B2

(12) United States Patent
Williams et al.

(10) Patent No.: US 12,607,380 B2
(45) Date of Patent: Apr. 21, 2026

(54) SYSTEM AND METHOD FOR OPERATING AN AIR CONDITIONER UNIT ACCORDING TO A PREDETERMINED SCHEDULE

(71) Applicant: Haier US Appliance Solutions, Inc., Wilmington, DE (US)

(72) Inventors: Craig Benjamin Williams, Louisville, KY (US); Justin Haag, Simpsonville, KY (US); Robert Jules LaFleur, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 290 days.

(21) Appl. No.: 18/339,047

(22) Filed: Jun. 21, 2023

(65) Prior Publication Data

US 2024/0426506 A1 Dec. 26, 2024

(51) Int. Cl.
*G06F 3/048* (2013.01)
*F24F 11/64* (2018.01)

(52) U.S. Cl.
CPC ..... *F24F 11/64* (2018.01)

(58) Field of Classification Search
CPC ..... F24F 11/64
See application file for complete search history.

(56) References Cited

U.S. PATENT DOCUMENTS 9,810,441 B2 11/2017 Dean-Hendricks et al.
10,551,813 B2 2/2020 Burt et al.
10,731,882 B2 8/2020 Abrishamkar et al.
11,306,938 B2 * 4/2022 Inoue ..... F24F 11/54
2011/0153090 A1 * 6/2011 Besore ..... G05B 15/02 700/278
2012/0186774 A1 * 7/2012 Matsuoka ..... F24F 11/523 165/11.1
2018/0335224 A1 * 11/2018 Rissler ..... F24F 11/50
2020/0248916 A1 8/2020 Tae et al.
2022/0299954 A1 * 9/2022 Wellig ..... G01S 13/56
2022/0333811 A1 * 10/2022 Bailey ..... F24F 11/64
2023/0304687 A1 * 9/2023 Nakajima ..... F24F 11/58
2024/0426506 A1 * 12/2024 Williams ..... F24F 11/61
2025/0109874 A1 * 4/2025 Walsdorf ..... F24F 11/64

* cited by examiner

*Primary Examiner* — David Phantana-angkool
(74) *Attorney, Agent, or Firm* — Dority & Manning, P.A.

(57) ABSTRACT

An air conditioning system for conditioning a room includes an air conditioner unit operable in at least one of a normal operating mode or an energy management mode; a plurality of occupancy indication devices; and a controller in operative communication with the air conditioner unit and the plurality of occupancy indication devices, the controller being configured to perform an operation. The operation includes determining that the air conditioner unit is operating within a first predetermined timeframe; directing the air conditioner unit according to the energy management mode after determining that the air conditioner unit is operating within the first predetermined timeframe; detecting a first trigger event within the room after directing the air conditioner unit according to the energy management mode; and directing the air conditioner unit at a selected setting upon detecting the first trigger event.

18 Claims, 8 Drawing Sheets

SYSTEM AND METHOD FOR OPERATING AN AIR CONDITIONER UNIT ACCORDING TO A PREDETERMINED SCHEDULE

FIELD OF THE INVENTION

The present disclosure relates generally to air conditioner units, and more particularly to methods of operating air conditioner units according to occupancy and schedules.

BACKGROUND OF THE INVENTION

Air conditioner or conditioning units are conventionally utilized to adjust the temperature indoors—i.e., within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected, by e.g., tubing carrying the refrigerant, to another portion located outdoors. These types of units are typically used for conditioning the air in larger spaces.

Another type of unit, sometimes referred to as a packaged terminal air conditioner unit (PTAC), may be used for somewhat smaller indoor spaces that are to be air conditioned. These units may include both an indoor portion and an outdoor portion separated by a bulkhead and may be installed in windows or positioned within an opening of an exterior wall of a building. Certain conventional PTACs or other HVAC systems adjust a target or setpoint room temperature based on occupancy. In this regard, if the space is unoccupied, the temperature and/or humidity setpoint may be changed for energy savings. By contrast, if the space is occupied, the temperature and/or humidity setpoint may be adjusted to provide optimum comfort.

However, conventional occupancy detection systems are often inaccurate, resulting in false readings of occupancy when the room is vacant and/or false readings of vacancy when the room is occupied. Notably, when a room is vacant but is determined to be occupied by the occupancy detection system, the system may be wasting energy. By contrast, when a room is occupied but is determined to be vacant by the occupancy detection system, the room may not be comfortable to the room occupant.

Accordingly, air conditioner units and methods of operating the same based on sensed occupancy are desired. More specifically, a system for establishing or incorporating schedules at which room occupancy is detected and adjusting the operation of an air conditioner unit for energy savings would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an air conditioning system is provided. The air conditioning system may include an air conditioner unit operable in at least one of a normal operating mode or an energy management mode; a plurality of occupancy indication devices; and a controller in operative communication with the air conditioner unit and the plurality of occupancy indication devices, the controller being configured to perform an operation. The operation may include determining that the air conditioner unit is operating within a first predetermined timeframe; directing the air conditioner unit according to the energy management mode after determining that the air conditioner unit is operating within the first predetermined timeframe; detecting a first trigger event within the room after directing the air conditioner unit according to the energy management mode; and directing the air conditioner unit at a selected setting upon detecting the first trigger event.

In another exemplary aspect of the present disclosure, a method of operating an air conditioning system is provided. The air conditioning system may include an air conditioner unit operable in a normal operating mode or an energy management mode and a plurality of occupancy indication devices. The method may include determining that the air conditioner unit is operating within a first predetermined timeframe; directing the air conditioner unit according to the energy management mode after determining that the air conditioner unit is operating within the first predetermined timeframe; detecting a first trigger event within the room after directing the air conditioner unit according to the energy management mode; and directing the air conditioner unit at a selected setting upon detecting the first trigger event.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
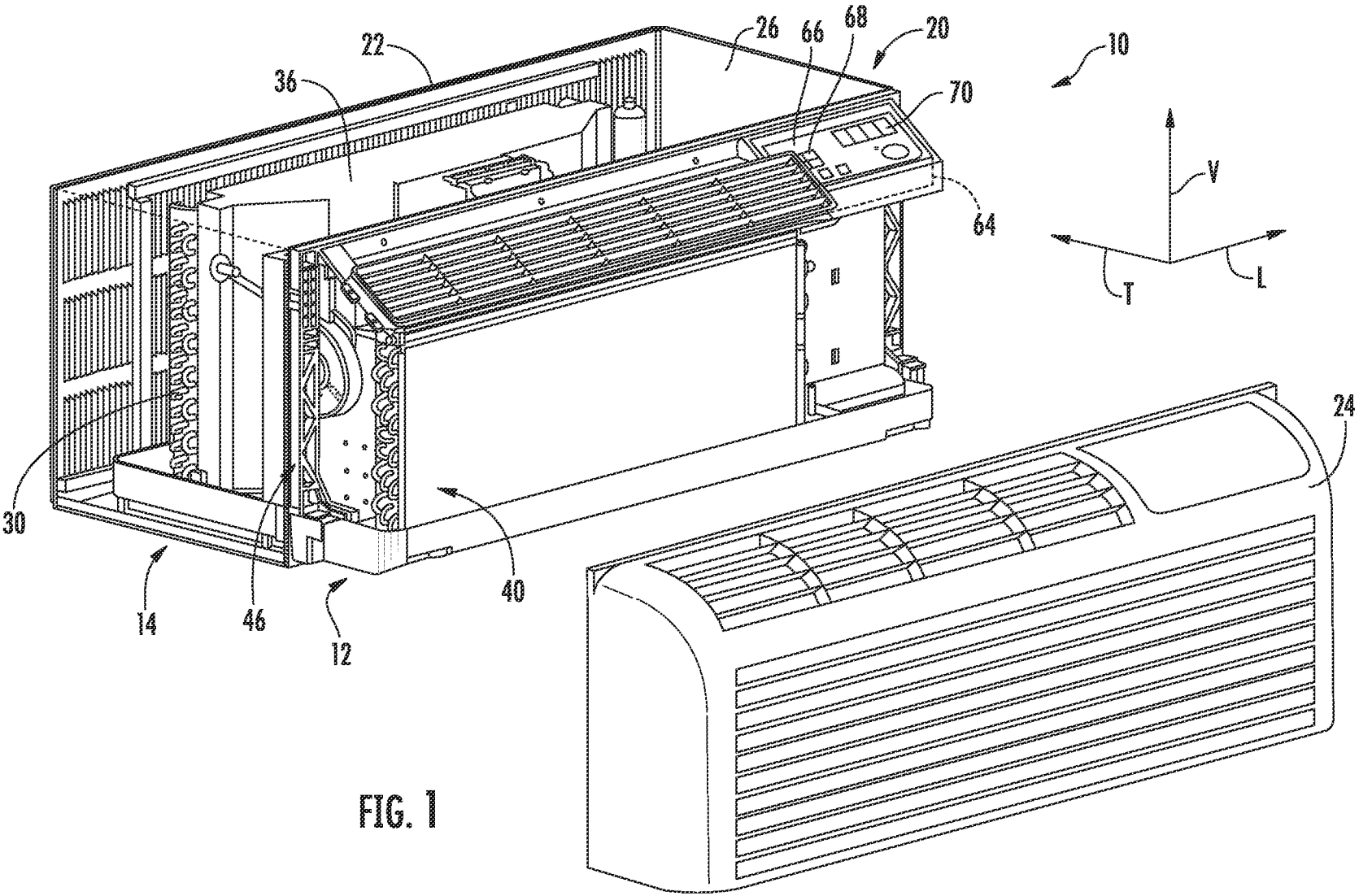
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V. L. T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32 (FIG. 2), and a compressor 34 (FIG. 2) may be housed within the wall sleeve 26. A casing 36 may additionally enclose outdoor fan 32, as shown.

Figure 2:
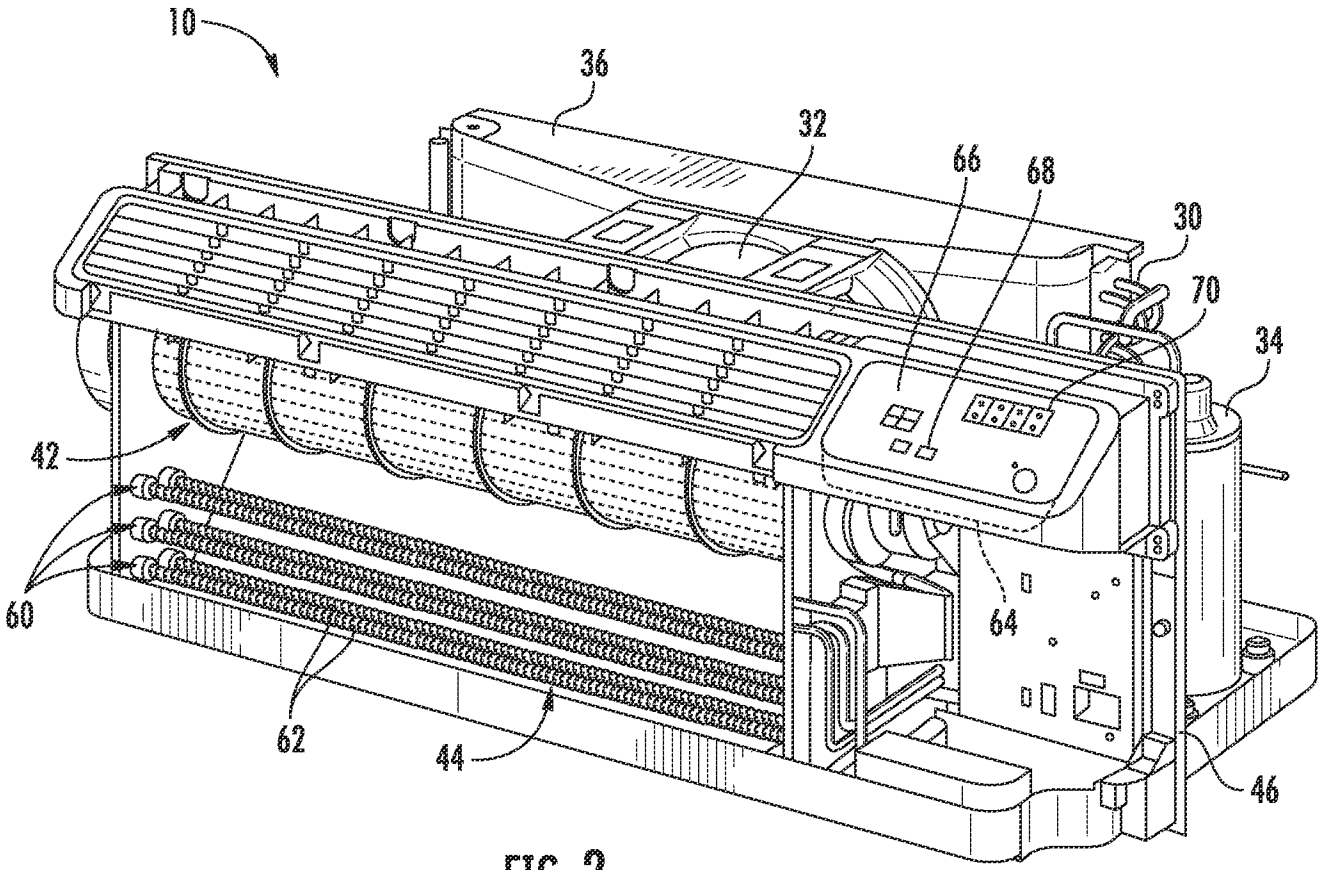
FIG. 2 is another perspective view of components of the indoor portion of the exemplary air conditioner unit of FIG. 1.

Referring now also to FIG. 2, indoor portion 12 may include, for example, an indoor heat exchanger 40 (FIG. 1), a blower fan 42, and a heating unit 44. These components may, for example, be housed behind the room front 24. Additionally, a bulkhead 46 may generally support and/or house various other components or portions thereof of the indoor portion 12, such as the blower fan 42 and the heating unit 44. Bulkhead 46 may generally separate and define the indoor portion 12 and outdoor portion 14.

Figure 3:
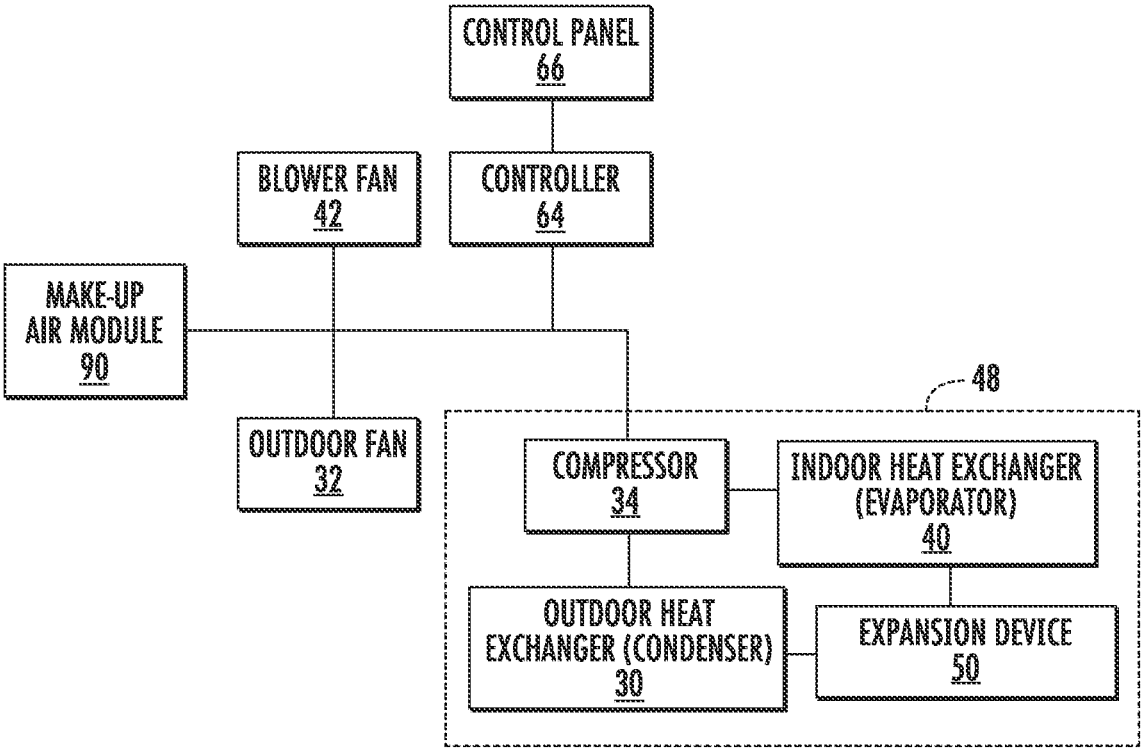
FIG. 3 is a schematic view of a refrigeration loop in accordance with one embodiment of the present disclosure.

Outdoor and indoor heat exchangers 30, 40 may be components of a refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such example and rather that any suitable refrigerant may be utilized.

As is understood in the art, refrigeration loop 48 may alternately be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed. e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be an electronic expansion valve that enables controlled expansion of refrigerant, as is known in the art. More specifically, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34. According to alternative embodiments, expansion device 50 may be a capillary tube or another suitable expansion device configured for use in a thermodynamic cycle.

According to the illustrated exemplary embodiment, outdoor fan 32 is an axial fan and indoor blower fan 42 is a centrifugal fan. However, it should be appreciated that according to alternative embodiments, outdoor fan 32 and blower fan 42 may be any suitable fan type. In addition, according to an exemplary embodiment, outdoor fan 32 and blower fan 42 are variable speed fans. For example, outdoor fan 32 and blower fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed. In addition, according to alternative embodiments, fans 32, 42 may be operated to urge make-up air into the room.

According to the illustrated embodiment, blower fan 42 may operate as an evaporator fan in refrigeration loop 48 to encourage the flow of air through indoor heat exchanger 40. Accordingly, blower fan 42 may be positioned downstream of indoor heat exchanger 40 along the flow direction of indoor air and downstream of heating unit 44. Additionally or alternatively, blower fan 42 may be positioned upstream of indoor heat exchanger 40 along the flow direction of indoor air and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Additionally or alternatively, however, any suitable number of heater banks 60 may be utilized. Each heater bank 60 may further include at least one heater coil or coil pass 62, such as in exemplary embodiments two heater coils or coil passes 62. Additionally or alternatively, other suitable heating elements may be utilized.

The operation of air conditioner unit 10 including compressor 34 (and thus refrigeration loop 48 generally) blower fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. As described in more detail below with respect to FIG. 8, the controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66 and may be in communication with the controller 64. Display 70 may, for example be a touchscreen or other text-readable display screen, or alternatively may simply be a light that can be activated and deactivated as required to provide an indication of, for example, an event or setting for the unit 10.

Figure 4:
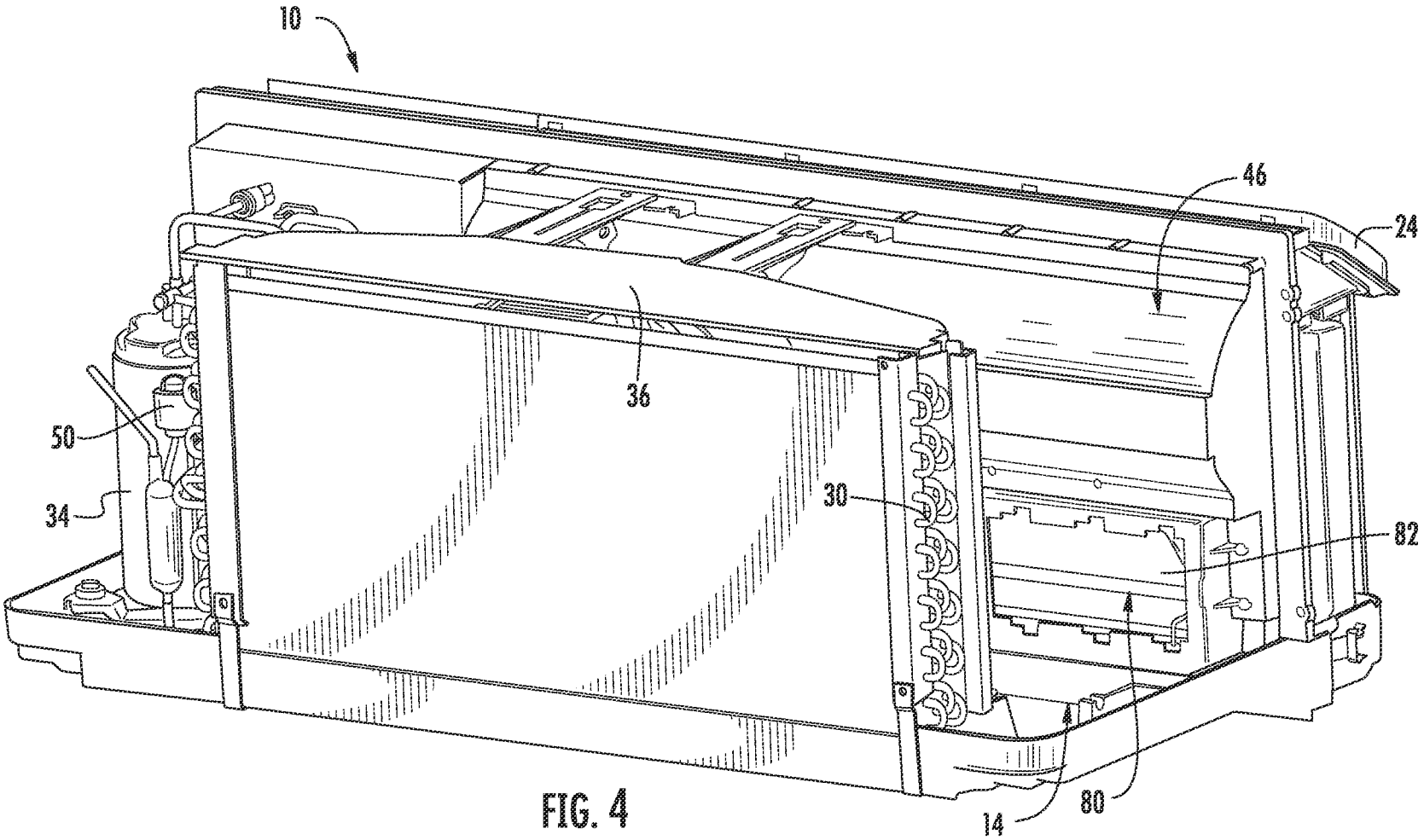
FIG. 4 is a rear perspective view of an outdoor portion of the exemplary air conditioner unit of FIG. 1, illustrating a vent aperture in a bulkhead assembly in accordance with one embodiment of the present disclosure.

Referring briefly to FIG. 4, a vent aperture 80 may be defined in bulkhead 46 providing fluid communication between indoor portion 12 and outdoor portion 14. Vent aperture 80 may be utilized in an installed air conditioner unit 10 to allow outdoor air to flow into the room through the indoor portion 12. In this regard, in some cases it may be desirable to allow outside air (i.e., "make-up air") to flow into the room in order, e.g., to meet government regulations, or to compensate for negative pressure created within the room. In this manner, according to an exemplary embodiment, make-up air may be provided into the room through vent aperture 80 when desired.

Figure 5:
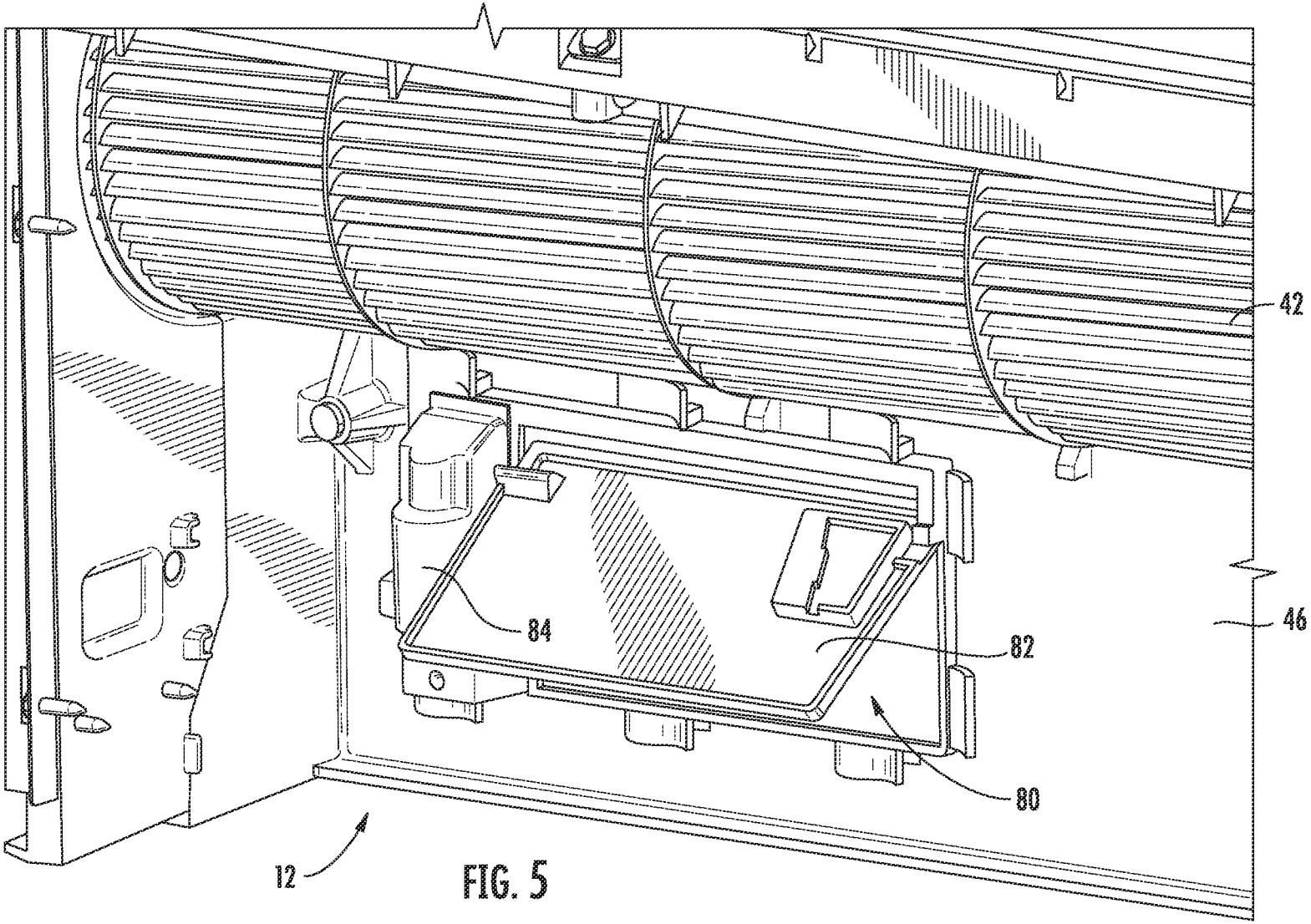
FIG. 5 is a front perspective view of the exemplary bulkhead assembly of FIG. 4 with a vent door illustrated in the open position in accordance with one embodiment of the present disclosure.

As shown in FIG. 5, a vent door 82 may be pivotally mounted to the bulkhead 46 proximate to vent aperture 80 to open and close vent aperture 80. More specifically, as illustrated, vent door 82 is pivotally mounted to the indoor facing surface of indoor portion 12. Vent door 82 may be configured to pivot between a first, closed position where vent door 82 prevents air from flowing between outdoor portion 14 and indoor portion 12, and a second, open position where vent door 82 is in an open position (as shown in FIG. 5) and allows make-up air to flow into the room. According to the illustrated embodiment vent door 82 may be pivoted between the open and closed position by an electric motor 84 controlled by controller 64, or by any other suitable method.

Figure 6:
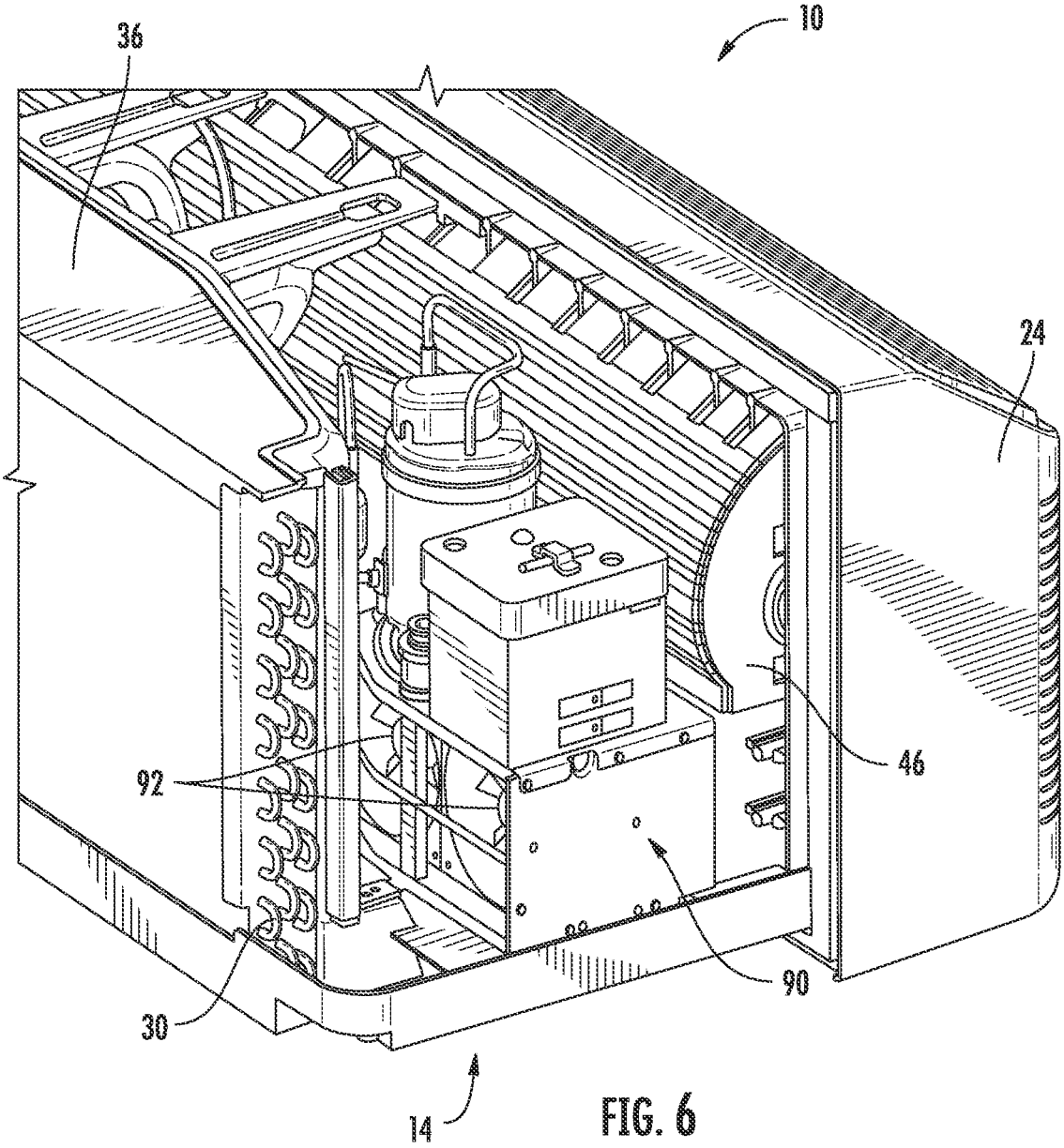
FIG. 6 is a rear perspective view of the exemplary air conditioner unit and bulkhead assembly of FIG. 4 including a sealed system for conditioning make-up air in accordance with one embodiment of the present disclosure.

In some cases, it may be desirable to treat or condition make-up air flowing through vent aperture 80 prior to blowing it into the room. For example, outdoor air which has a relatively high humidity level may require treating before passing into the room. In addition, if the outdoor air is cool, it may be desirable to heat the air before blowing it into the room. Therefore, as illustrated in FIG. 6, unit 10 may further include an auxiliary sealed system, or make-up air module 90, for conditioning make-up air. As shown, make-up air module 90 and/or an auxiliary fan 92 are positioned within outdoor portion 14 adjacent vent aperture 80 and vent door 82 is positioned within indoor portion 12 over vent aperture 80, though other configurations are possible. According to the illustrated embodiment auxiliary sealed system 90 may be controlled by controller 64, by another dedicated controller, or by any other suitable method.

As illustrated, make-up air module 90 includes auxiliary fan 92 that is configured as part of auxiliary sealed system 90 and may be configured for urging a flow of air through auxiliary sealed system 90. Auxiliary sealed system 90 may further includes one or more compressors, heat exchangers, and any other components suitable for operating auxiliary sealed system 90 similar to refrigeration loop 48 described above to condition make-up air. For example, auxiliary system 90 can be operated in a dehumidification mode, an air conditioning mode, a heating mode, a fan only mode where only auxiliary fan 92 is operated to supply outdoor air, an idle mode, etc.

Figure 7:
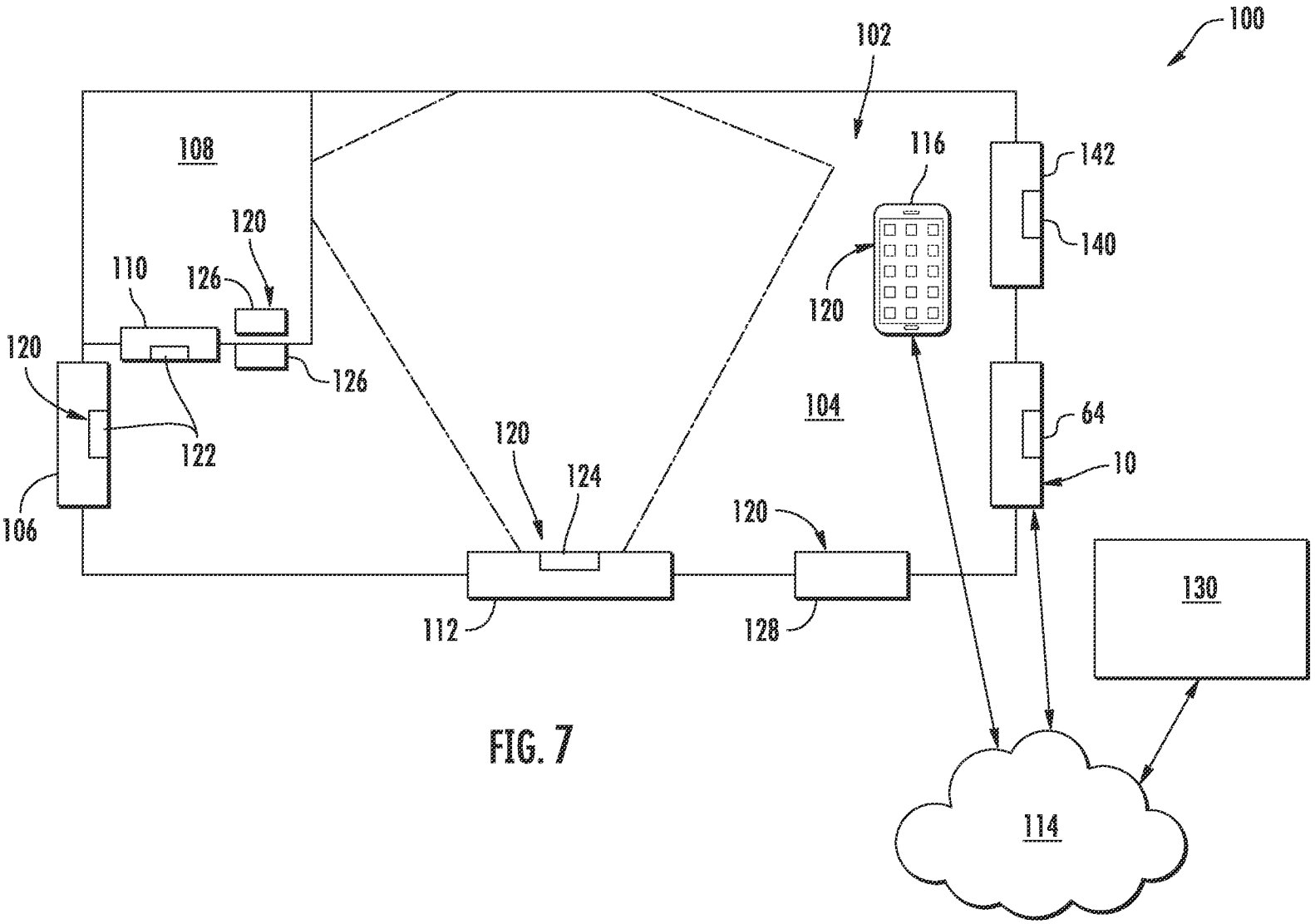
FIG. 7 is a schematic view of an air conditioning system that operates based on occupancy detection according to an exemplary embodiment of the present subject matter.

Referring now to FIG. 7, an air conditioning system 100 that is operably coupled with a room 102 for conditioning the room 102 will be described according to exemplary embodiments of the present subject matter. Specifically, according to the illustrated embodiment, room 102 may be a hotel room that includes a primary living space 104 accessed by a room door 106 and a bathroom 108 separated from the primary living space 104 by a bathroom door 110. In this regard, room door 106 may generally be used to exit room 102, while bathroom door 110 is an interior door that does not provide for egress from room 102. While bathroom door 110 is described and illustrated, it should be appreciated that other exemplary interior doors include closet doors, bedroom doors, or any other non-exit doors. It should further be noted that the exemplary room provided in FIG. 7 is but one example of a room, building, or other structure to which air conditioning system 100 may be applied. For instance, air conditioning system 100 may be applicable to such structures as assisted living facilities, retail stores or shops, public gymnasiums, office buildings and suites, seasonal buildings (e.g., remote hotels or extended stays), shared spaces (e.g., rental houses), or the like.

In addition, air conditioning system 100 may include an air conditioner unit, illustrated herein as air conditioner unit 10, e.g., as a packaged terminal air conditioner (PTAC) mounted on an exterior wall of room 102. However, it should be appreciated that aspects of the present subject matter may be generally directed to air conditioning systems for heating, cooling, dehumidifying, or otherwise conditioning any suitable room or area. In addition, although air conditioner unit 10 is described herein as a PTAC, aspects of the present subject matter may also utilize single package vertical units (SPVU), split heat pump systems, etc. Other system configurations are possible while remaining within the scope of the present subject matter.

According to the illustrated embodiment, air conditioning system 100 further includes a thermostat 112 that is mounted within room 102 (e.g., on a wall within primary living space 104). In general, thermostat 112 is used to regulate operation of air conditioner unit 10, e.g., by providing temperature and/or humidity setpoints. In this regard, for example, the room occupant, hotel owner, or other user of air conditioning system 100 may interact with thermostat 112 to input the desired room conditions (e.g., temperature, humidity, etc.) that should be targeted when the occupant is present within the room. In addition, thermostat 112 may include one or more temperature and/or humidity sensors for detecting room conditions to ensure that air conditioner unit 10 operates to maintain these conditions at or near the target or setpoint.

According to the illustrated embodiment, thermostat 112 is mounted on a wall of primary living space 104 and is communicatively coupled with air conditioner unit 10 using any suitable wired or wireless connection. For example, thermostat 112 and other various components of air conditioning system 10 may be in direct or indirect communication with each other and/or air conditioner unit 10 using any suitable wired or wireless connection and one or more networks 114. However, it should be appreciated that thermostat 112 could be positioned at any other suitable location and may communicate with air conditioner unit 10 using any suitable wired or wireless connection. For example, thermostat 112 may be part of air conditioner unit 10, e.g., integrated into control panel 66.

According to exemplary embodiments, a remote device 116 of the user or room occupant may operate as an input device for entering the target temperatures or regulating operation of air conditioner unit 10. In general, remote device 116 may be any suitable device separate from air conditioner unit 10 that is configured to provide and/or receive communications, information, data, or commands from a user. In this regard, remote device 116 may be, for example, a personal phone, a smartphone, a tablet, a laptop or personal computer, a wearable device, a smart home system, or another mobile or remote device.

In general, network 114 may generally be configured for permitting interaction, data transfer, and other communications between air conditioner unit 10 and one or more device, sensors, or inputs of air conditioning system 10, e.g., to improve performance of and/or improve user interaction with air conditioning system 100. Network communications may be carried using any type of wired or wireless connection and using any suitable type of communication network, non-limiting examples of which are provided below. For example, remote device 116 may be in direct or indirect communication with air conditioner unit 10 through any suitable wired or wireless communication connections or interfaces, such as network 114. For example, network 114 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP. HTTP. SMTP, FTP), encodings or formats (e.g., HTML, XML), and/or protection schemes (e.g., VPN, secure HTTP, SSL).

Network 114 is described herein according to an exemplary embodiment of the present subject matter. However, it should be appreciated that the exemplary functions and configurations of network 114 provided herein are used only as examples to facilitate description of aspects of the present subject matter. System configurations may vary, other communication devices may be used to communicate directly or indirectly with one or more associated appliances or devices, other communication protocols and steps may be implemented, etc. These variations and modifications are contemplated as within the scope of the present subject matter.

During operation, air conditioner unit 10 may generally be configured to operate in various operating modes. For example, air conditioner unit 10 may operate in a "normal" mode, an "occupancy" mode, a "vacancy" mode, an "energy savings" or "energy management" mode, etc. In general, the terms occupancy mode and the like are generally intended to refer to the desired or target operation of air conditioner unit 10 when occupants are present (or likely to be present) within room 102. By contrast, the terms vacancy mode and the like are generally intended to refer to the desired or target operation of air conditioner unit 10 when occupants are not present (or not likely present) within room 102. According to exemplary embodiments, the energy savings mode may generally refer to the desired operation of air conditioner unit 10 when it is desirable to conserve energy. For example, the energy savings mode may generally be the same or similar as the vacancy mode, but this mode may be manually entered using control panel 66, thermostat 112, or through external sensors (as described below).

According to example embodiments, the occupancy mode generally prioritizes tracking of a temperature setpoint over energy savings and the vacancy mode generally prioritizes energy savings over tracking of the temperature setpoint. In this regard, for example, if it is 85° Fahrenheit outside and an occupant sets the room temperature to 70° Fahrenheit, air conditioner unit 10 will cool the room to 70° Fahrenheit when in occupancy mode (e.g., when occupant is in room 102), regardless of the energy inefficiencies or costs. By contrast, if air conditioner unit 10 is operating in vacancy mode (e.g., when no occupant is present), air conditioner unit may target 70° Fahrenheit, but may operate under energy usage limits or setbacks that prevent the room from actually reaching the target temperature. For example, air conditioner unit 10 may maintain the room temperature at around 75° Fahrenheit to conserve energy while permitting the room to be quickly cooled to the target if an occupant is detected. Additional or alternative setbacks may be instituted within the energy savings or energy management mode, such as reduced control over humidity, reduced fan operation, or the like.

According to still other embodiments, operating in the vacancy mode may include adjusting the target temperature by a predetermined temperature offset (e.g., in degrees Fahrenheit) closer to the outside temperature or in a manner that reduces energy usage. Thus, if it is cooler outside than the target room temperature, operating in the vacancy mode may include reducing the target temperature, e.g., by 5 or 10° Fahrenheit (e.g., from 70° Fahrenheit to 65° Fahrenheit). By contrast, if it is hotter outside than the target room temperature, operating in the vacancy mode may include increasing the target temperature, e.g., by 5 or 10° Fahrenheit (e.g., from 70° Fahrenheit to 75° Fahrenheit). Other suitable temperature offsets are possible and within the scope of the present subject matter.

Notably, in order to facilitate improved determination of the room occupancy status, air conditioner system may include various devices that are intended to provide data or information indicative of room occupancy status, e.g., referred to herein generally as occupancy indication devices 120. In general, controller 64 of air conditioner unit, thermostat 112, etc. may be in communication with each of the occupancy indication devices 120 for obtaining data indicative of room occupancy. In this regard, controller 64 may be programmed for utilizing various sources of data related to room occupancy to more accurately detect the presence or absence of room occupants and thus to facilitate unit operation in the desired modes for improved user satisfaction and energy savings. Although exemplary occupancy indication devices 120 are described below, it should be appreciated that these devices are only exemplary and are not intended to limit the scope present subject matter. Additionally or alternatively, such occupancy indication devices 120 may be utilized only when air conditioning system 100 is operating within the energy savings or energy management mode. For instance, when air conditioning system 100 is operating within the energy management mode, one or more of the occupancy indication devices 120 may be activated and monitored to detect the presence of a person within the target area. Accordingly, the one or more setbacks may be applied until one of the occupancy indication devices 120 triggers air conditioning system 100 to drive the air conditioner unit 10 to return to the target temperature. Moreover, when air conditioning system 100 is operating within the normal or occupied modes, the target temperature (or humidity) may be maintained without any setbacks being applied.

According to exemplary embodiments, occupancy indication devices 120 may include one or more door sensors (identified generally by reference numeral 122), door lock sensors, keycard access devices, or other input sources that may be triggered when a user passes through a door. For example, a door sensor 122 may be positioned on room door 106 to detect a person entering or leaving room 102. If air conditioner unit 10 is in the occupancy mode (e.g., indicating that an occupant is within room 102) and door sensor 122 on room door 106 is triggered, this may indicate that the occupant has left the room. If other occupancy indication devices 120 do not provide other information indicating positive occupancy (e.g., thus corroborating the possibility that the occupant has left room 102), the unit may enter vacancy mode. By contrast, if door sensor 122 on bathroom door 110 is triggered, this may be a strong indication of room occupancy, so the unit may enter the occupancy mode. Similarly, a strong indication of occupancy may occur when any other interior door (e.g., closet door, bedroom door in a suite, etc.) is triggered.

According to still other exemplary embodiments, occupancy indication devices 120 may include one or more motion sensors 124 position within room 102. For example, according to the illustrated embodiment, thermostat 112 may include a motion sensor 124 position thereon and directed into a primary living space 104. According to still other embodiments, room 102 may include other motion sensors 124 positioned at other locations. In addition, air conditioning system 10 may include one or more smart light switches 126 that are in operative communication with air conditioner unit 10 for indicating user interaction with such light switches 126.

Conditioning system 100 may include additional occupancy indication devices 120 in the form of connected appliances or devices, such as mobile phones, alarm clocks, room phones, televisions, etc. In this regard, as illustrated, air-conditioning system 100 may include a television 128, e.g., a smart TV or connected TV appliance that can be in communication with the television remote and with air conditioner unit 10. Accordingly, when a user is interacting with television 128, e.g., by changing channels, adjusting volumes, etc., this may be a strong indication of room occupancy. In addition, the remote device 116 associated with a user (e.g., an occupant's cell phone) may be in operable communication with controller 64 for providing the user's location or proximity as data indicative of occupancy.

According to still other embodiments, an external source positioned outside of the room 102 may be used to specify room occupancy. In this regard, for example, the occupancy indication devices 120 may include a master control source 130 configured to specify an occupancy status or adjust an occupancy countdown timer (described below). For example, in a hotel setting, the front desk may wish to act as a master control source for specifying when an occupant leaves the room (e.g., at checkout) or enters room (e.g., at check-in).

Referring still to FIG. 7, air-conditioning system 10 may further include an exterior access sensor 140 that is generally configured for detecting when outdoor air is being let into room 102. For example, exterior access sensor 140 may be mounted to or operably coupled with a window 142 or an exterior door of room 102. When the window 142 is opened, exterior access sensor 140 may notify controller 64. According to exemplary embodiments, controller 64 may enter an energy savings mode (e.g., or a vacancy mode) when exterior access sensor 140 detects that the window 142 has been opened.

FIG. 7 describes one exemplary configuration of air conditioning system 100 for controlling the operation of air conditioner unit 10 for the purpose of explaining aspects of the present subject matter. However, it should be appreciated that although specific exemplary embodiments are described, modifications and variations may be made to the illustrated air conditioning system 100 while remaining within the scope of the present subject matter. For example, the configuration of room 102 may vary, a different type of air conditioner unit 10 may be used, other occupancy indication devices 120 are possible, etc.

Now that the construction of air conditioner unit 10 and the configuration of air conditioning system 100 according to exemplary embodiments has been presented, an exemplary method 200 of controlling an air conditioner unit will be described. Although the discussion below refers to the exemplary method 200 of operating air conditioner unit 10 using air conditioning system 100, one skilled in the art will appreciate that the exemplary method 200 is applicable to the operation of a variety of other air conditioning appliances using any suitable number and type of occupancy indication devices. In exemplary embodiments, the various method steps as disclosed herein may be performed by controller 64, although a dedicated controller may be used according to alternative embodiments.

Figure 8:
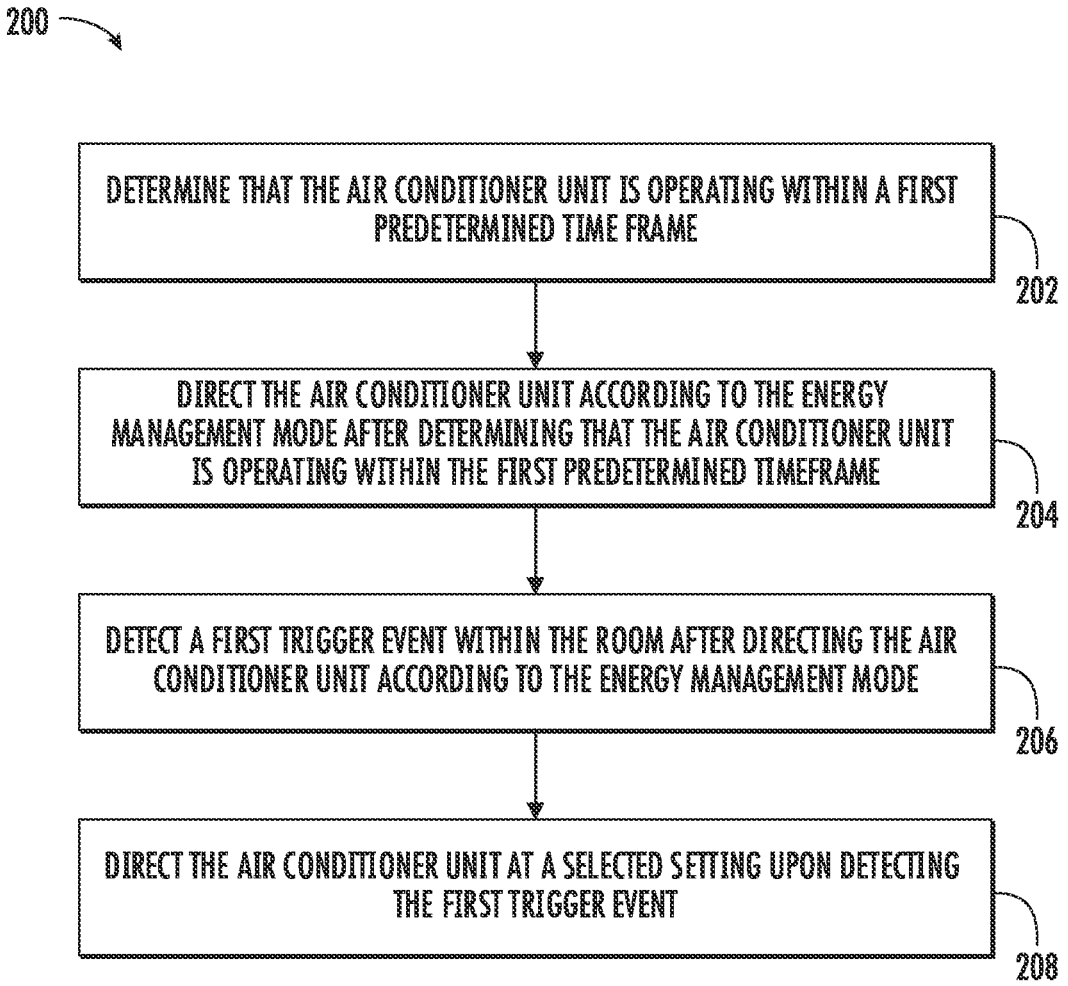
FIG. 8 illustrates a method for controlling an air conditioning system in accordance with one embodiment of the present disclosure.

Referring now to FIG. 8, method 200 may include determining that the air conditioner unit is operating within a first predetermined timeframe. According to at least some embodiments, the air conditioner unit (e.g., air conditioner unit 10) may be programmed according to a schedule such as a predetermined schedule. For instance, the predetermine schedule may be set or chosen by a user (e.g., end user) of the air conditioner unit. As described above, the air conditioner unit may be configured to operate according to a plurality of modes (e.g., normal mode, energy management mode, etc.). The predetermined schedule may thus include a plurality of timeframes during which the air conditioner unit is to be operated according to a specified mode. According to at least some examples, the predetermined schedule is provided as a lookup table (e.g., within the air conditioner unit).

The first predetermined timeframe may be associated with a particular operating mode. For instance, the first predetermined timeframe may be associated with the energy management mode of operation. The first predetermined timeframe may be associated with a timeframe during which the room (or otherwise designated area) is unlikely to be occupied. According to one example, the area is a retail store having predefined hours of operation (e.g., 9:00 AM through 9:00 PM). After closing, the retail store is unlikely to be occupied (e.g., by employees, shoppers, etc.). The after hours (e.g., 9:00 PM through 9:00 AM the following day) may be designated as the first predetermined timeframe. Additionally or alternatively, the open hours may be designated as a second predetermined timeframe. As mentioned above, the area may be one of a plurality of areas subject to varying hours of operation and, accordingly, likely occupancy.

Additionally or alternatively, the predetermined schedule may include a plurality of predetermined timeframes. Each of the plurality of predetermined timeframes may be measured in at least one of hours, days, weeks, months, or the like. For instance, referring again to the example above, the first predetermined timeframe may be measured in hours (e.g., 12 hours). The second predetermined timeframe may also be measured in hours (e.g., 12 hours). Accordingly, the first predetermined timeframe and the second predetermined timeframe may be separate and distinct. Moreover, additional predetermined timeframes may be incorporated (e.g., at different measurements). For instance, a first predetermined timeframe may be about 8 hours, a second predetermined timeframe may be about 8 hours, and a third predetermined timeframe may be about 8 hours.

Further still, the first predetermined timeframe may be split around the a different (e.g., the third) predetermined timeframe. For instance, the first predetermined timeframe may be defined between a first block or portion and a second block or portion. The third predetermined timeframe may thus be defined between the first block and the second block. For example, the first block of the first predetermined timeframe may be between about 9:00 AM and about 12:00 PM. The third predetermined timeframe may be between about 12:00 PM and about 1:00 PM. The second block of the first predetermined timeframe may then be between about 1:00 PM and about 9:00 PM. The second predetermined timeframe may be defined between about 9:00 PM and 9:00 AM the following day.

As yet another example, a seasonal (e.g., weekly, monthly) timeframe may be defined as the first (or second, etc.) predetermined timeframe. For example, the first predetermined timeframe may be defined between the month of May and the month of October. The second predetermined timeframe may be defined between the month of November and the month of April. Additionally or alternatively, each of the first and second predetermined timeframes may include one or more sub-timeframes. For instance, during the first predetermined seasonal timeframe, a first predetermined sub-timeframe may be defined (e.g., as nights, weekends, etc.). A second predetermined sub-timeframe may be defined (e.g., as days, weekdays, etc.). Accordingly, multiple predetermined timeframes and sub-timeframes having different measurement units may be defined within the predetermined schedule.

At step 204, method 200 may include directing the air conditioner unit according to the energy management mode after determining that the air conditioner unit is operating within the first predetermined timeframe. Thus, once it has been determined that the air conditioner unit is operating within the first predetermined timeframe, the air conditioner unit may be directed according to a predetermined mode (e.g., the energy management mode). Thus, one or more setbacks may be applied to the air conditioner unit. For instance, as mentioned above, the air conditioner unit may adjust one or more operating parameters when operating according to the energy management mode. For instance, the target temperature (e.g., temperature setpoint) may be adjusted closer to a measured external (e.g., outdoor) temperature. Additionally or alternatively, a humidifying (or dehumidifying) operation may be reduced or halted. Advantageously, certain energy saving features may be recognized during the predetermined timeframe when few to no people are predicted to be present within the room or space.

At step 206, method 200 may include detecting a first trigger event within the room after directing the air conditioner unit according to the energy management mode. While operating within the energy management mode (e.g., during the first predetermined timeframe), each of the occupancy indication devices may be activated. Accordingly, as the air conditioner unit is operated with the one or more setbacks applied, one or more of the occupancy indication devices may produce a trigger or trigger event (e.g., a motion sensor may be tripped, a door may be opened, etc.). The trigger event may include detecting a change in a temperature setpoint of the air conditioner unit. Additionally or alternatively, the trigger event may include various user interactions with the air conditioner unit (or thermostat), such as a fan initiation, a humidity adjustment, or the like. It should be understood that the trigger events described herein are provided by way of example, and the disclosure is not limited to the examples given herein.

At step 208, method 200 may include directing the air conditioner unit at a selected setting upon detecting the first trigger event. In detail, upon receiving or detecting the trigger (or trigger event), the method may return the air conditioner unit to a standard operating level (e.g., to condition the room or space to the target temperature, humidity, etc.). The air conditioner unit may thus be directed or driven at the normal (or occupied) mode (e.g., eliminating any setbacks). A timer may be included and initiated when the trigger event is detected or registered. For instance, the air conditioner unit may be adjusted to the normal operating mode at the initiation of the timer. The timer may have a predetermined length associated therewith. For instance, the predetermined length of time for the timer may be set or adjusted by the user. Further, the predetermined length of time for the timer may vary according to a length of the first predetermined timeframe. For instance, the timer may be shorter when the first predetermined timeframe is measured according to hours (e.g., as opposed to days, weeks, months, etc.). Similarly, the timer may be longer when the first predetermined timeframe is measured according to weeks or months. For instance, when the first predetermined timeframe is measured according to weeks or months, the trigger event may suggest that a person will be present within the room for an extended period of time.

The method 200 may include determining that the air conditioner unit is operating within the second predetermined timeframe (or otherwise outside of the first predetermined timeframe). As mentioned above, the second predetermined timeframe may be associated with a time during which the room or space is likely to be occupied (e.g., business hours, waking hours, in-season hours, etc.). During the second predetermined timeframe, the air conditioner unit may be operated according to the normal mode. The normal mode may have no setbacks associated therewith. Accordingly, the air conditioner unit may be operated so as to maintain the target temperature (and humidity, if available) as closely as possible. Advantageously, occupant comfort is maximized when the room is likely to be occupied, while energy savings is maximized when the room is likely to be unoccupied.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioning system for conditioning a room, the air conditioning system comprising:

an air conditioner unit operable in at least one of a normal operating mode or an energy management mode;

a plurality of occupancy indication devices; and a controller in operative communication with the air conditioner unit and the plurality of occupancy indication devices, the controller being configured to perform an operation, the operation comprising:

determining that the air conditioner unit is operating within a first predetermined timeframe of a plurality of predetermined timeframes of a predetermined schedule;

directing the air conditioner unit according to the energy management mode after while it is determined that the air conditioner unit is operating within the first predetermined timeframe;

detecting a first trigger event within the room while it is determined that the air conditioner unit is operating within the first predetermined timeframe; and directing the air conditioner unit at a selected setting upon detecting the first trigger event.

2. The air conditioning system of claim 1, wherein the operation further comprises:

determining that the air conditioner unit is operating within a second predetermined timeframe of the plurality of predetermined time frames different from the first predetermined timeframe; and directing the air conditioner unit according to the normal operating mode, the normal operating mode comprising no setbacks.

3. The air conditioning system of claim 2, wherein the room is in an unoccupied state during the first predetermined timeframe and the room is in an occupied state during the second predetermined timeframe.

4. The air conditioning system of claim 2, wherein the second predetermined timeframe comprises a plurality of second predetermined timeframes measured in at least one of hours, days, weeks, or months.

5. The air conditioning system of claim 2, wherein directing the air conditioner unit according to the energy management mode comprises:

applying one or more setbacks to the air conditioner unit; and operating the air conditioner unit at a reduced capacity according to the one or more setbacks.

6. The air conditioning unit of claim 2, wherein the first predetermined timeframe and the second predetermined timeframe are retrieved from the predetermined schedule, which is provided within a lookup table.

7. The air conditioning system of claim 1, wherein the plurality of occupancy indication devices comprises:

at least one of a door position sensor, a door lock or keycard access device, a motion sensor positioned within the room, or an occupancy sensor mounted to the air conditioner unit.

8. The air conditioning system of claim 1, wherein identifying the first trigger event comprises detecting a change in a temperature setpoint of the air conditioner unit or other user interaction with the air conditioner unit.

9. The air conditioning system of claim 1, wherein identifying the first trigger event comprises detecting an occupant of the room via at least one of the plurality of occupancy indication devices.

10. A method of operating an air conditioning system, the air conditioning system comprising an air conditioner unit operable in a normal operating mode or an energy management mode and a plurality of occupancy indication devices, the method comprising:

determining that the air conditioner unit is operating within a first predetermined timeframe of a plurality of predetermined timeframes of a predetermined schedule;

directing the air conditioner unit according to the energy management mode while it is determined that the air conditioner unit is operating within the first predetermined timeframe;

detecting a first trigger event within the room while it is determined that the air conditioner unit is operating within the first predetermined timeframe; and directing the air conditioner unit at a selected setting upon detecting the first trigger event.

11. The method of claim 10, further comprising:

determining that the air conditioner unit is operating within a second predetermined timeframe of the plurality of predetermined time frames different from the first predetermined timeframe; and directing the air conditioner unit according to the normal operating mode, the normal operating mode comprising no setbacks.

12. The method of claim 11, wherein the room is in an unoccupied state during the first predetermined timeframe and the room is in an occupied state during the second predetermined timeframe.

13. The method of claim 11, wherein the second predetermined timeframe comprises a plurality of second predetermined timeframes measured in at least one of hours, days, weeks, or months.

14. The method of claim 11, wherein directing the air conditioner unit according to the energy management mode comprises:

applying one or more setbacks to the air conditioner unit; and operating the air conditioner unit at a reduced capacity according to the one or more setbacks.

15. The method of claim 11, wherein the first predetermined timeframe and the second predetermined timeframe are retrieved from the predetermined schedule, which is provided within a lookup table.

16. The method of claim 10, wherein the plurality of occupancy indication devices comprises:

at least one of a door position sensor, a door lock or keycard access device, a motion sensor positioned within the room, or an occupancy sensor mounted to the air conditioner unit.

17. The method of claim 10, wherein identifying the first trigger event comprises detecting a change in a temperature setpoint of the air conditioner unit or other user interaction with the air conditioner unit.

18. The method of claim 10, wherein identifying the first trigger event comprises detecting an occupant of the room via at least one of the plurality of occupancy indication devices.

* * * * *